US012378855B2

(12) United States Patent
AlFawwaz et al.

(10) Patent No.: US 12,378,855 B2
(45) Date of Patent: Aug. 5, 2025

(54) OFFSHORE UNMANNED SMART RESERVOIR MANAGEMENT

(71) Applicant: Saudi Arabian Oil Company, Dhahran (SA)

(72) Inventors: Abdullah A. AlFawwaz, Dhahran (SA); Ghazi Dhafer AlQahtani, Al-Khafji (SA)

(73) Assignee: Saudi Arabian Oil Company, Dhahran (SA)

( * ) Notice: Subject to any disclaimer, the term of this patent is extended or adjusted under 35 U.S.C. 154(b) by 456 days.

(21) Appl. No.: 17/929,265

(22) Filed: Sep. 1, 2022

(65) Prior Publication Data

US 2024/0076970 A1 Mar. 7, 2024

(51) Int. Cl.
*E21B 43/12* (2006.01)

(52) U.S. Cl.
CPC ..... *E21B 43/128* (2013.01); *E21B 43/123* (2013.01); *E21B 43/12* (2013.01); *E21B 2200/20* (2020.05); *E21B 2200/22* (2020.05)

(58) Field of Classification Search
CPC ..... E21B 43/123
See application file for complete search history.

(56) References Cited

U.S. PATENT DOCUMENTS 6,266,619 B1 7/2001 Thomas et al.
7,079,952 B2 7/2006 Thomas et al.
2012/0130696 A1* 5/2012 Davidson ..... G06Q 10/06375 703/10
2013/0173168 A1* 7/2013 Abitrabi ..... E21B 43/32 702/6

(Continued)

FOREIGN PATENT DOCUMENTS

WO WO 2005101060 10/2005

OTHER PUBLICATIONS

Danquingy et al., "Production optimization by real-time modeling and alarming: The Sendji Field Case," SPE 110296, presented at the SPE Annual Technical Conference, Nov. 11-14, 2007, 10 pages.

*Primary Examiner* — Nathan L Laughlin
(74) *Attorney, Agent, or Firm* — Fish & Richardson P.C.

(57) ABSTRACT

Systems and methods include a computer-implemented system. Measurement tools provide real-time measurements for wells and reservoir performance. Control valves are automatically controlled in response to events occurring in the wells. A network provide s communications between the measurement tools, the control valves, and command centers. The command centers provide information to reservoir and production engineers monitoring the group of wells. A technical reservoir and production engineering domain monitors performance indicators for the reservoir and group of wells for events requiring corrective action to be taken. The system includes processors and a non-transitory computer-readable storage medium including programming instructions to: determine that at least one operating constraint for the reservoir and group of wells exceeds predetermined reservoir engineering limits by a pre-determined threshold; automatically transmit instructions for performing an action identified by a Level 1 or 2 command center; and automatically change settings in the control valves.

15 Claims, 4 Drawing Sheets

(56) References Cited

U.S. PATENT DOCUMENTS

| | | | | |
|---|---|---|---|---|
| 2016/0010445 | A1* | 1/2016 | Harrison | E21B 47/00 702/6 |
| 2016/0053593 | A1* | 2/2016 | Romer | F04F 1/08 700/282 |
| 2021/0042634 | A1* | 2/2021 | Maucec | G06N 5/022 |
| 2022/0372860 | A1* | 11/2022 | Allen | G06Q 10/06313 |
| 2023/0195145 | A1* | 6/2023 | Vessaire | G05D 7/0676 700/282 |
| 2024/0018856 | A1* | 1/2024 | Chhatre | E21B 43/168 |

* cited by examiner

OFFSHORE UNMANNED SMART RESERVOIR MANAGEMENT

TECHNICAL FIELD

The present disclosure applies to managing smart reservoirs.

BACKGROUND

Reservoirs (e.g., oil reservoirs) may have multiple wells (e.g., oil wells), each well having instruments such as downhole sensors and valves. Typically, monitoring smart reservoirs requires actions by on-site personnel, even when using real-time monitoring and control of the wells. Requiring on-site personnel adds to overall production costs, e.g., of oil exploration and operations.

SUMMARY

The present disclosure describes techniques that can be used for managing smart reservoirs. In some implementations, a computer-implemented system includes the following. Measurement tools are configured to provide real-time measurements for wells and reservoir performance for a reservoir and a group of wells. Control valves are configured to be automatically controlled in response to events occurring in the group of wells. A network is configured to provide communications between the measurement tools, the control valves, and command centers. The command centers are configured to provide information to reservoir and production engineers monitoring the group of wells. A technical reservoir and production engineering domain is configured to monitor, using the network, performance indicators for the reservoir and group of wells for events requiring corrective action to be taken in the reservoir and group of wells. The system includes one or more processors and a non-transitory computer-readable storage medium coupled to the one or more processors and storing programming instructions for execution by the one or more processors. The programming instructions instruct the one or more processors to perform operations including: determining that at least one operating constraint for the reservoir and group of wells exceeds pre-determined reservoir engineering limits by a pre-determined threshold; automatically transmitting, through the network, instructions for performing an action identified by a Level 1 command center or a Level 2 command center; and automatically changing, based at least on the instructions, settings in one or more of the control valves.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Techniques can include unmanned reservoir management and control for wells. Doing so can provide a significant business impact in optimizing costs and minimizing negative impacts of surface facility operation upsets. This can include eliminating adverse influences of rough sea weather conditions and ensuring sustained field production targets. For example, during rough sea weather conditions, operators typically cannot use the service boats to approach each jacket individually if not hooked through a supervisory control and data acquisition (SCADA) system. This can result in several wells being outside the range of surveillance and control. Techniques of the present disclosure can eliminate such challenges using self-jacket control. Smart reservoir management and reservoir production engineering guidelines and practices can be adopted and applied in command centers that automatically manage and control well performance and well fields. By comparison, conventional techniques may not apply corrective actions, such as automatically choking, by a command center, high gas oil ratio (GOR) wells, or high water cut (WC) wells. Instead, conventional techniques may only provide reports and recommendations. Further, conventional techniques typically do not ensure meeting global field targets by automatically compensating production losses that may occur. Conventional techniques do not provide automated reservoir management for wells that are candidates for pressure transient analysis (PTA), for production logging, or for well head integrity inspection. Techniques of the present disclosure can allow engineers to remotely control wells by shutting them down with no need to send a field service technical crew to the location of the well offshore, or to close the well and prepare the well for PTA, production logging, or well head integrity check. This advantage saves time and money while applying timely reservoir management practices and guidelines, regardless of the weather condition.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

Figure 1:
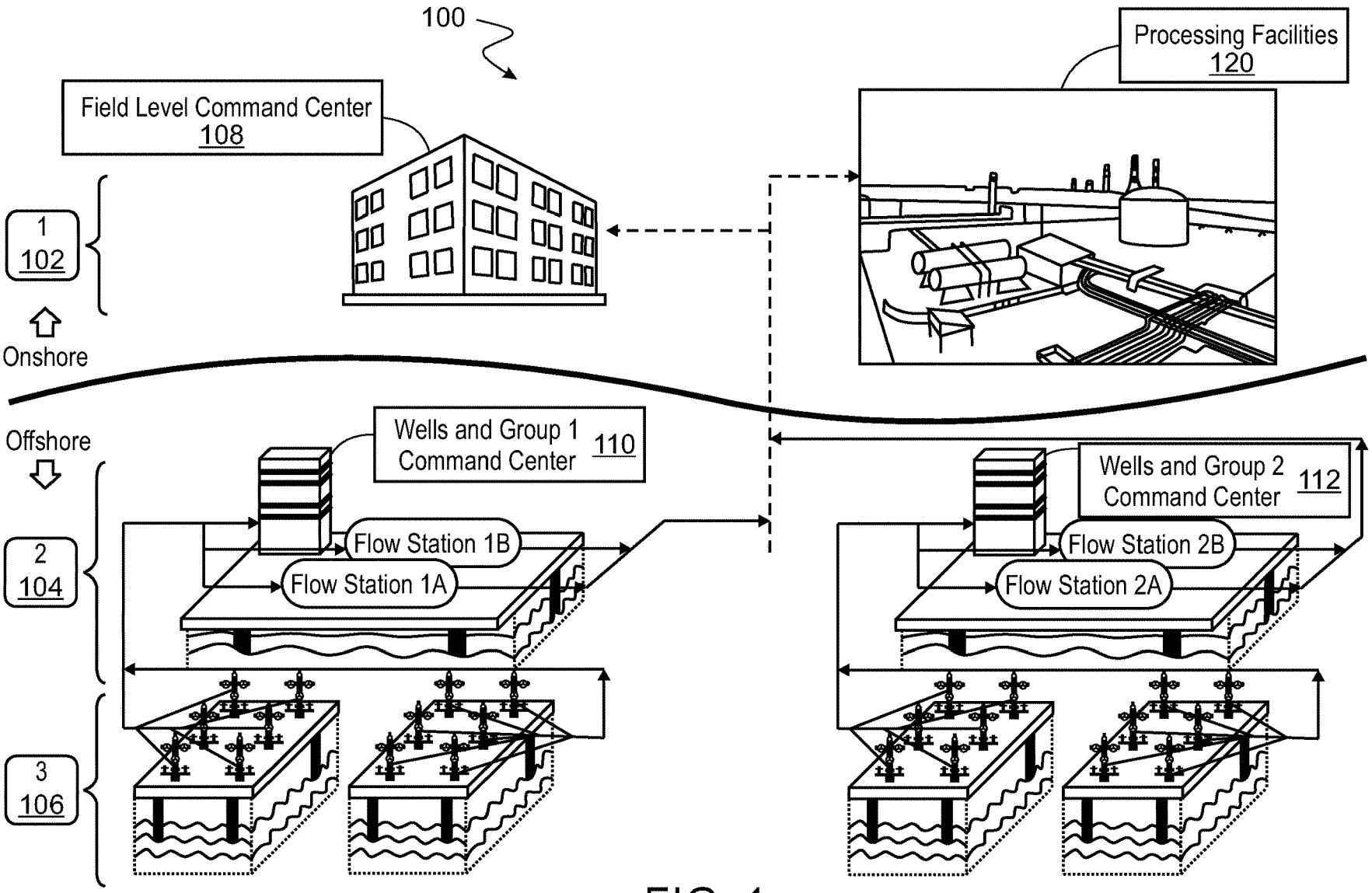
FIG. 1 is a diagram showing an example system providing offshore smart reservoir management, according to some implementations of the present disclosure.

The following detailed description describes techniques for managing smart reservoirs. Various modifications, alterations, and permutations of the disclosed implementations can be made and will be readily apparent to those of ordinary skill in the art, and the general principles defined may be applied to other implementations and applications, without departing from the scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

The present disclosure introduces two phases of reservoir surveillance and control that are linked to local (well and group level) command centers and global (field level) command centers. The command centers are unmanned and are configured to automatically and seamlessly manage and control wells and field production. The present disclosure includes a framework, including a process and a design that enhances reservoir management and control of offshore fields. The framework includes a network of production platforms by which reservoir performance and data can be measured. Several data types can be collected at the well level and/or at the production platform level. The data types can include at least reservoir pressure, production rate (oil, gas, and water), annulus pressure, electrical submersible pump (ESP) pressure and rate readings, gas lift measurements, and temperature. The data can be gathered from the network of production platforms to group level flow stations where the information can be subjected to reservoir management and can provide control operational commands. At the same time, the gathered performance data can be monitored by reservoir and production engineers using a production system dashboard showing wells and reservoir performance indicators, and command actions to be taken can be triggered if concurred by the engineer. The commands can act as regulators for managing and controlling different levels of wells, jackets, group flow stations, and field production. As an example, a jacket is a small, steel platform used for drilling wells in shallow and/or calm water. The commands can honor offshore and onshore production facility operating constraints at different levels. The commands can also be designed to maintain field production targets by automatically initiating optimum and/or remedial actions that are connected through valve actuators for individual wells at different group levels such as choking, closing, relaxing, and opening of the wells. These actions can ensure that production targets are sustained at group and field levels by seamlessly controlling productivity at the wells and orchestrating choke settings to compensate for any production loss due to monitored reservoir performance indicators or any operational challenges. Reservoir performance indicators can be designed to meet field production targets and other group level operating constraints such as maximum water cut (WC) ratio and maximum limits for Gas Oil Ratio (GOR). If one of the operating constraints is triggered, then the wells and group command center can reduce or choke the well with a high WC and/or GOR. This can be done to compensate for lost production from other wells to ensure that field level production targets are met. The operational challenges may be related to integrity issues or any shutdown in the processing surface facilities. The wells and group command centers can automatically compensate for any lost production to meet field target rates from unaffected wells.

FIG. 1 is a diagram showing an example system 100 providing offshore smart reservoir management, according to some implementations of the present disclosure. The system 100 includes two major features. The first feature is related to Level 3 components (offshore wells 106) and level 2 components (group flow stations 104). For Level 3 and Level 2 components, reservoir and production engineering practices can be implemented using command lines that are triggered when wells and/or reservoir productivity are known to be exhibiting poor or unfavorable performance. For instance, if the WC at Level 3 exceeds pre-determined reservoir engineering limits by a pre-determined threshold percentage (e.g., 50%), then the wells and group command center 110, 112 can be triggered and an automatic choking can occur. For example, the choking can be applied to the well that has exceeded the allowed WC. At the same time, the wells and group command center can ensure that field production targets are met, e.g., by opening and/or relaxing other wells' choke valves through actuators to compensate for the lost production.

The second part is related to Level 1 components 102 denoted in FIG. 1 at which reservoir engineering experts can use field level command centers 108 to gain, from history matched up-to-date reservoir simulation model, the three-year operating business plan for the field. This includes the targeted production year on monthly basis and the operating constraints that should be honored for producing water and gas due to offshore and/or onshore facility capacity (e.g., processing facility 120) limitations in handling unwanted fluids. Reservoir management practices to operate the field and the wells are transformed into global Level 1 commands which have the field production target to be maintained the list wells with their expected productivity that are updated on monthly bases from wells ability rate tests. The monitored data can be used as an update to reservoir simulation models in real-time options.

Figure 2:
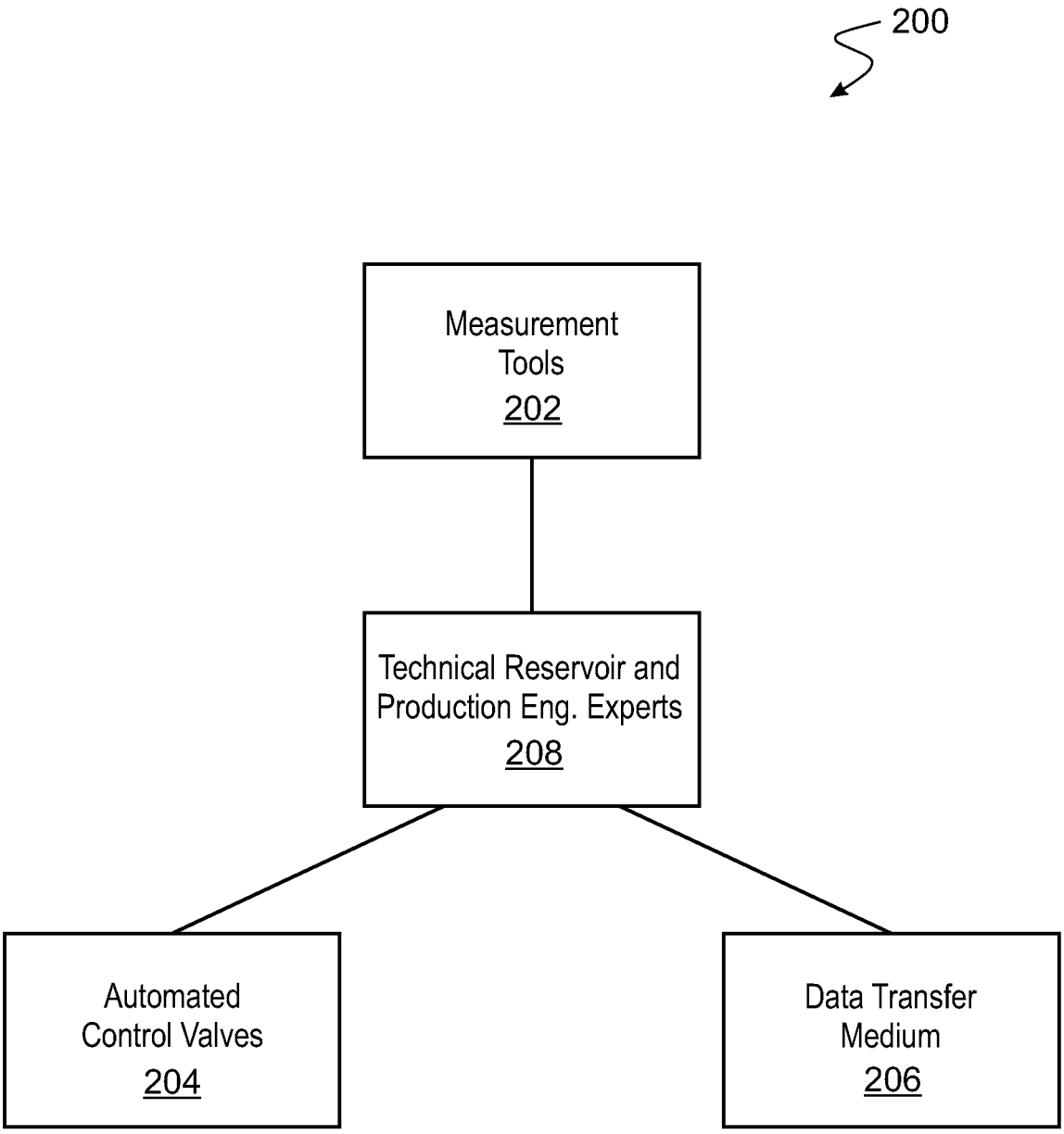
FIG. 2 is a diagram showing example components of smart reservoir management, according to some implementations of the present disclosure.

FIG. 2 is a diagram showing example components of smart reservoir management 200, according to some implementations of the present disclosure. The smart reservoir management 200 includes four main components 202-208 that enables the system to function.

Measurement tools 202 such as permanent downhole pressure, multi-phase flow meters, subsurface and surface pressure gauges, annulus pressure gauges, and temperature measurements. These tools provide real-time measurements for wells and reservoir performance which are monitored by reservoir and production engineers in Level 2 and/or Level 1 command centers.

Automatic controlled valves 204 such as well head wing valves, annulus valves, and flow lines control valves. These valves can be regulated by the wells and group command center automatically, including times at which operating constraints are triggered by events such as WC, GOR, reservoir bubble point pressure, and/or flow line back pressure.

Data transfer medium 206 which can be wired or wireless. The measurement tools data can be communicated to Level 2 wells and group command centers and Level 1 field level command center 108. At these command centers, reservoir and production engineers can monitor performance indicators for subsurface and surface pressure readings, fluid flow rate measurements, WC, and GOR. If one of the operating constraints is triggered, an automatic action is sent from either Level 2 or 1 to control the problematic well through the data transfer medium.

Technical Reservoir and production engineering domain group 208. Reservoir engineering experts can translate the three-year business operating plan for the field into an objective function with operating constraints. The production optimization problem is transformed into command lines in global field Level 1 and/or in local group Level 2. If any of the operating constraints are triggered, corrective actions can be performed by Level 1 command centers 110 or Level 2 command centers 112 that will ensure meeting global level field production target. Using dashboards and other user interfaces, for example, production engineers can monitor well productivity and operations at wells and group command centers to ensure that healthy wells performance indicators continue for every data measured. Well fluency of the wells and group command centers can be ensured by applying needed corrective action once operating constraints are triggered.

Figure 3:
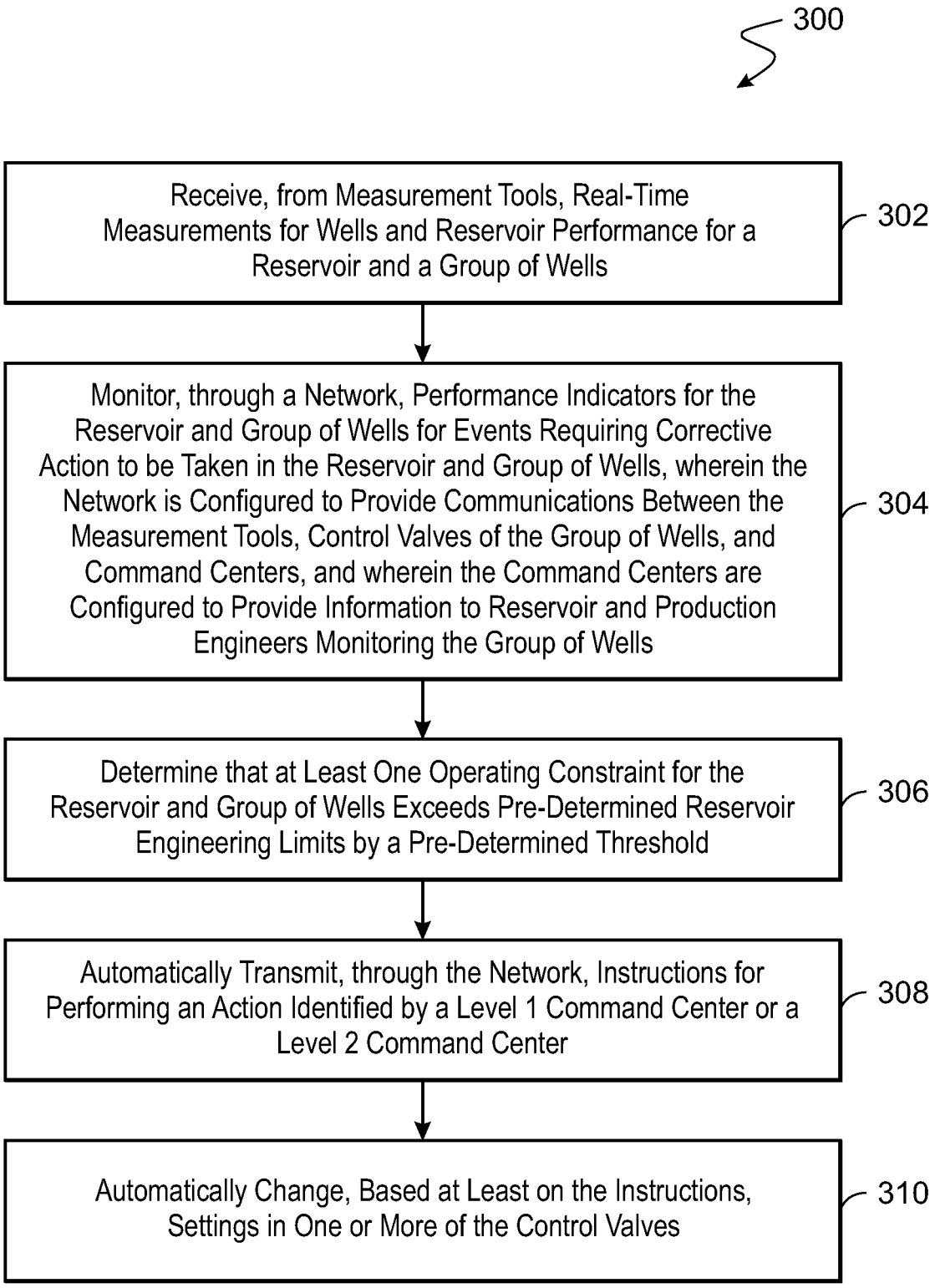
FIG. 3 is a flowchart of an example of a method for executing components of a smart reservoir management system, according to some implementations of the present disclosure

FIG. 3 is a flowchart of an example of a method 300 for executing components of a smart reservoir management system, according to some implementations of the present disclosure. For clarity of presentation, the description that follows generally describes method 300 in the context of the other figures in this description. However, it will be understood that method 300 can be performed, for example, by any suitable system, environment, software, and hardware, or a combination of systems, environments, software, and hardware, as appropriate. In some implementations, various steps of method 300 can be run in parallel, in combination, in loops, or in any order.

At 302, real-time measurements for wells and reservoir performance for a reservoir and a group of wells are received from measurement tools. As an example, the measurement tools can include permanent downhole pressure gauges, multi-phase flow meters, subsurface and surface pressure gauges, annulus pressure gauges, and temperature measurement devices. The measurement tools can be monitored automatically by the system 200 and by reservoir and production engineers in Level 1 and Level 2 command centers. From 302, method 300 proceeds to 304.

At 304, performance indicators for the reservoir and group of wells are monitored, through a network, for events requiring corrective action to be taken in the reservoir and group of wells. The network is configured to provide communications between the measurement tools, control valves of the group of wells, and command centers. The command centers are configured to provide information to reservoir and production engineers monitoring the group of wells. The network can support wired and wireless communications. The performance indicators can be associated with subsurface and surface pressure readings, fluid flow rate measurements, water cut (WC), and gas oil ratio (GOR). The performance indicators include data types for reservoir pressure, oil production rates, gas production rates, water production rates, annulus pressure, electrical submersible pump (ESP) pressure and rate readings, gas lift measurements, and temperature. From 304, method 300 proceeds to 306.

At 306, determination is made that at least one operating constraint for the reservoir and group of wells exceeds pre-determined reservoir engineering limits by a pre-determined threshold. As an example, the determination can be made by the system 200, as described with reference to FIG. 2. From 306, method 300 proceeds to 308.

At 308, instructions for performing an action identified by a Level 1 command center or a Level 2 command center are automatically transmitted through the network. As an example, the determination can be made by the system 200, as described with reference to FIG. 2. From 308, method 300 proceeds to 310.

At 310, settings in one or more of the control valves are automatically changed based at least on the instructions. For example, the instructions for performing the action identified by the Level 1 command center or the Level 2 command center can be automatically transmitted through the network. After 310, method 300 can stop.

In some implementations, method 300 further includes implementing three-year business operating plans for the reservoir and group of wells into an objective function with the operating constraints.

In some implementations, in addition to (or in combination with) any previously-described features, techniques of the present disclosure can include the following. Outputs of the techniques of the present disclosure can be performed before, during, or in combination with wellbore operations, such as to provide inputs to change the settings or parameters of equipment used for drilling. Examples of wellbore operations include forming/drilling a wellbore, hydraulic fracturing, and producing through the wellbore, to name a few. The wellbore operations can be triggered or controlled, for example, by outputs of the methods of the present disclosure. In some implementations, customized user interfaces can present intermediate or final results of the above described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or "app"), or at a central processing facility. The presented information can include suggestions, such as suggested changes in parameters or processing inputs, that the user can select to implement improvements in a production environment, such as in the exploration, production, and/or testing of petrochemical processes or facilities. For example, the suggestions can include parameters that, when selected by the user, can cause a change to, or an improvement in, drilling parameters (including drill bit speed and direction) or overall production of a gas or oil well. The suggestions, when implemented by the user, can improve the speed and accuracy of calculations, streamline processes, improve models, and solve problems related to efficiency, performance, safety, reliability, costs, downtime, and the need for human interaction. In some implementations, the suggestions can be implemented in real-time, such as to provide an immediate or near-immediate change in operations or in a model. The term real-time can correspond, for example, to events that occur within a specified period of time, such as within one minute or within one second. Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

Figure 4:
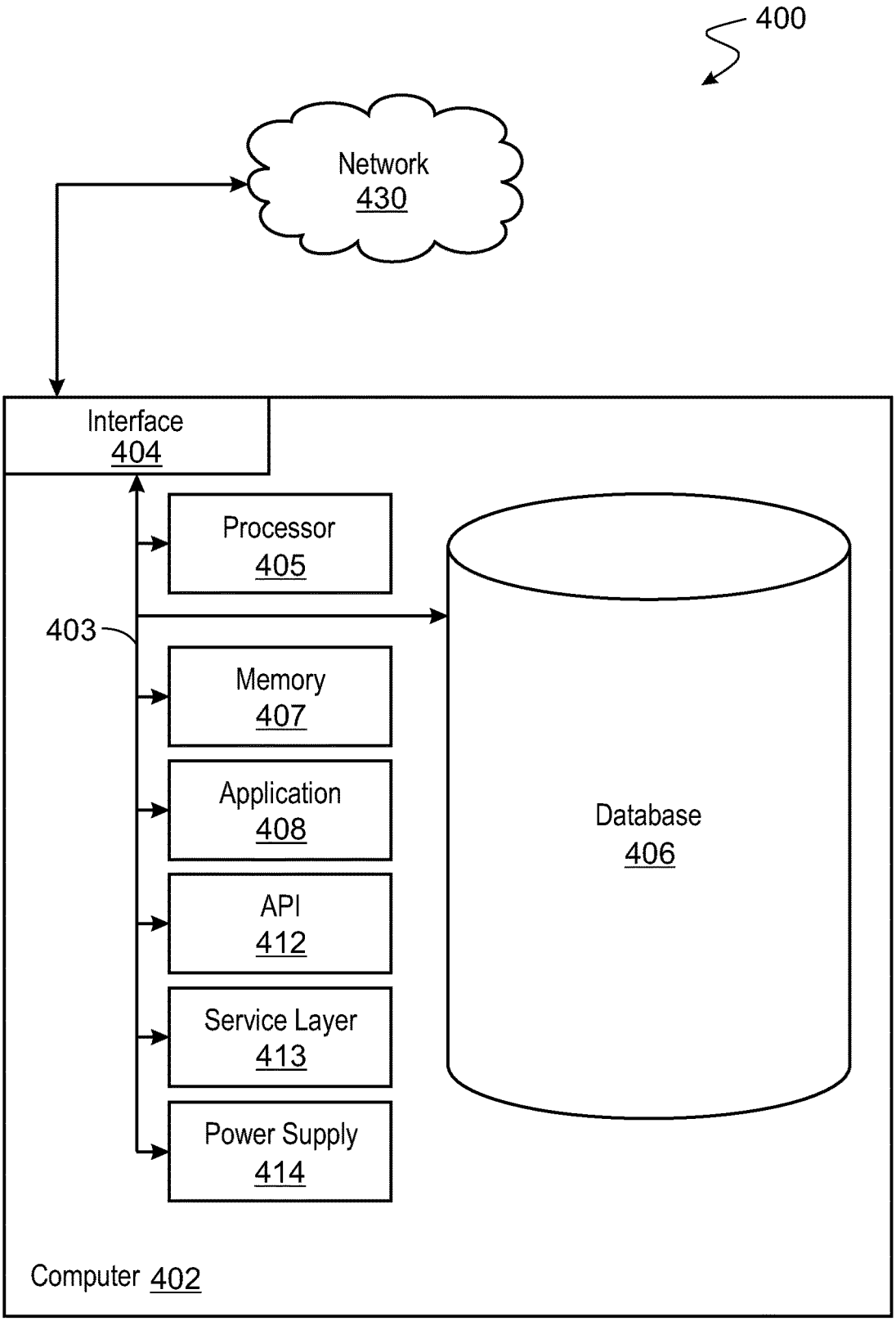
FIG. 4 is a block diagram illustrating an example computer system used to provide computational functionalities associated with described algorithms, methods, functions, processes, flows, and procedures as described in the present disclosure, according to some implementations of the present disclosure.

FIG. 4 is a block diagram of an example computer system 400 used to provide computational functionalities associated with described algorithms, methods, functions, processes, flows, and procedures described in the present disclosure, according to some implementations of the present disclosure. The illustrated computer 402 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 402 can include input devices such as keypads, keyboards, and touch screens that can accept user information. Also, the computer 402 can include output devices that can convey information associated with the operation of the computer 402. The information can include digital data, visual data, audio information, or a combination of information. The information can be presented in a graphical user interface (UI) (or GUI).

The computer 402 can serve in a role as a client, a network component, a server, a database, a persistency, or components of a computer system for performing the subject matter described in the present disclosure. The illustrated computer 402 is communicably coupled with a network 430. In some implementations, one or more components of the computer 402 can be configured to operate within different environments, including cloud-computing-based environments, local environments, global environments, and combinations of environments.

At a top level, the computer 402 is an electronic computing device operable to receive, transmit, process, store, and manage data and information associated with the described subject matter. According to some implementations, the computer 402 can also include, or be communicably coupled with, an application server, an email server, a web server, a caching server, a streaming data server, or a combination of servers.

The computer 402 can receive requests over network 430 from a client application (for example, executing on another computer 402). The computer 402 can respond to the received requests by processing the received requests using software applications. Requests can also be sent to the computer 402 from internal users (for example, from a command console), external (or third) parties, automated applications, entities, individuals, systems, and computers.

Each of the components of the computer 402 can communicate using a system bus 403. In some implementations, any or all of the components of the computer 402, including hardware or software components, can interface with each other or the interface 404 (or a combination of both) over the system bus 403. Interfaces can use an application programming interface (API) 412, a service layer 413, or a combination of the API 412 and service layer 413. The API 412 can include specifications for routines, data structures, and object classes. The API 412 can be either computer-language independent or dependent. The API 412 can refer to a complete interface, a single function, or a set of APIs.

The service layer 413 can provide software services to the computer 402 and other components (whether illustrated or not) that are communicably coupled to the computer 402. The functionality of the computer 402 can be accessible to all service consumers using this service layer. Software services, such as those provided by the service layer 413, can provide reusable, defined functionalities through a defined interface. For example, the interface can be software written in JAVA, C++, or a language providing data in extensible markup language (XML) format. While illustrated as an integrated component of the computer 402, in alternative implementations, the API 412 or the service layer 413 can be stand-alone components in relation to other components of the computer 402 and other components communicably coupled to the computer 402. Moreover, any or all parts of the API 412 or the service layer 413 can be implemented as child or sub-modules of another software module, enterprise application, or hardware module without departing from the scope of the present disclosure.

The computer 402 includes an interface 404. Although illustrated as a single interface 404 in FIG. 4, two or more interfaces 404 can be used according to particular needs, desires, or particular implementations of the computer 402 and the described functionality. The interface 404 can be used by the computer 402 for communicating with other systems that are connected to the network 430 (whether illustrated or not) in a distributed environment. Generally, the interface 404 can include, or be implemented using, logic encoded in software or hardware (or a combination of software and hardware) operable to communicate with the network 430. More specifically, the interface 404 can include software supporting one or more communication protocols associated with communications. As such, the network 430 or the interface's hardware can be operable to communicate physical signals within and outside of the illustrated computer 402.

The computer 402 includes a processor 405. Although illustrated as a single processor 405 in FIG. 4, two or more processors 405 can be used according to particular needs, desires, or particular implementations of the computer 402 and the described functionality. Generally, the processor 405 can execute instructions and can manipulate data to perform the operations of the computer 402, including operations using algorithms, methods, functions, processes, flows, and procedures as described in the present disclosure.

The computer 402 also includes a database 406 that can hold data for the computer 402 and other components connected to the network 430 (whether illustrated or not). For example, database 406 can be an in-memory, conventional, or a database storing data consistent with the present disclosure. In some implementations, database 406 can be a combination of two or more different database types (for example, hybrid in-memory and conventional databases) according to particular needs, desires, or particular implementations of the computer 402 and the described functionality. Although illustrated as a single database 406 in FIG. 4, two or more databases (of the same, different, or combination of types) can be used according to particular needs, desires, or particular implementations of the computer 402 and the described functionality. While database 406 is illustrated as an internal component of the computer 402, in alternative implementations, database 406 can be external to the computer 402.

The computer 402 also includes a memory 407 that can hold data for the computer 402 or a combination of components connected to the network 430 (whether illustrated or not). Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 (of the same, different, or combination of types) can be used according to particular needs, desires, or particular implementations of the computer 402 and the described functionality. While memory 407 is illustrated as an internal component of the computer 402, in alternative implementations, memory 407 can be external to the computer 402.

The application 408 can be an algorithmic software engine providing functionality according to particular needs, desires, or particular implementations of the computer 402 and the described functionality. For example, application 408 can serve as one or more components, modules, or applications. Further, although illustrated as a single application 408, the application 408 can be implemented as multiple applications 408 on the computer 402. In addition, although illustrated as internal to the computer 402, in alternative implementations, the application 408 can be external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion and management circuits, including recharging, standby, and power management functionalities. In some implementations, the power supply 414 can include a power plug to allow the computer 402 to be plugged into a wall socket or a power source to, for example, power the computer 402 or recharge a rechargeable battery.

There can be any number of computers 402 associated with, or external to, a computer system containing computer 402, with each computer 402 communicating over network 430. Further, the terms "client," "user," and other appropriate terminology can be used interchangeably, as appropriate, without departing from the scope of the present disclosure. Moreover, the present disclosure contemplates that many users can use one computer 402 and one user can use multiple computers 402.

Described implementations of the subject matter can include one or more features, alone or in combination.

For example, in a first implementation, a computer-implemented system includes the following. Measurement tools are configured to provide real-time measurements for wells and reservoir performance for a reservoir and a group of wells. Control valves are configured to be automatically controlled in response to events occurring in the group of wells. A network is configured to provide communications between the measurement tools, the control valves, and command centers. The command centers are configured to provide information to reservoir and production engineers monitoring the group of wells. A technical reservoir and production engineering domain is configured to monitor, using the network, performance indicators for the reservoir and group of wells for events requiring corrective action to be taken in the reservoir and group of wells. The system includes one or more processors and a non-transitory computer-readable storage medium coupled to the one or more processors and storing programming instructions for execution by the one or more processors. The programming instructions instruct the one or more processors to perform operations including: determining that at least one operating constraint for the reservoir and group of wells exceeds pre-determined reservoir engineering limits by a pre-determined threshold; automatically transmitting, through the network, instructions for performing an action identified by a Level 1 command center or a Level 2 command center; and automatically changing, based at least on the instructions, settings in one or more of the control valves.

The foregoing and other described implementations can each, optionally, include one or more of the following features:

A first feature, combinable with any of the following features, where the measurement tools include permanent downhole pressure gauges, multi-phase flow meters, subsurface and surface pressure gauges, annulus pressure gauges, and temperature measurement devices.

A second feature, combinable with any of the previous or following features, where the measurement tools are monitored by reservoir and production engineers in Level 1 and Level 2 command centers.

A third feature, combinable with any of the previous or following features, where the network supports wired and wireless communications.

A fourth feature, combinable with any of the previous or following features, where the performance indicators are associated with subsurface and surface pressure readings, fluid flow rate measurements, water cut (WC), and gas oil ratio (GOR).

A fifth feature, combinable with any of the previous or following features, where the performance indicators include data types for reservoir pressure, oil production rates, gas production rates, water production rates, annulus pressure, electrical submersible pump (ESP) pressure and rate readings, gas lift measurements, and temperature.

A sixth feature, combinable with any of the previous or following features, where operations further include implementing three-year business operating plans for the reservoir and group of wells into an objective function with the at least one operating constraint.

A seventh feature, combinable with any of the previous or following features, where the at least one operating constraint is included in a production optimization problem transformed into command lines to be executed by command centers.

In a second implementation, a computer-implemented method includes: receiving, from measurement tools, real-time measurements for wells and reservoir performance for a reservoir and a group of wells; monitoring, through a network, performance indicators for the reservoir and group of wells for events requiring corrective action to be taken in the reservoir and group of wells, where the network is configured to provide communications between the measurement tools, control valves of the group of wells, and command centers, and where the command centers are configured to provide information to reservoir and production engineers monitoring the group of wells; determining that at least one operating constraint for the reservoir and group of wells exceeds pre-determined reservoir engineering limits by a pre-determined threshold; automatically transmitting, through the network, instructions for performing an action identified by a Level 1 command center or a Level 2 command center; and automatically changing, based at least on the instructions, settings in one or more of the control valves.

The foregoing and other described implementations can each, optionally, include one or more of the following features:

A first feature, combinable with any of the following features, where the measurement tools include permanent downhole pressure gauges, multi-phase flow meters, subsurface and surface pressure gauges, annulus pressure gauges, and temperature measurement devices.

A second feature, combinable with any of the following features, where the measurement tools are monitored by reservoir and production engineers in Level 1 and Level 2 command centers.

A third feature, combinable with any of the following features, where the network supports wired and wireless communications.

A fourth feature, combinable with any of the following features, where the performance indicators are associated with subsurface and surface pressure readings, fluid flow rate measurements, water cut (WC), and gas oil ratio (GOR).

A fifth feature, combinable with any of the following features, where the performance indicators include data types for reservoir pressure, oil production rates, gas production rates, water production rates, annulus pressure, electrical submersible pump (ESP) pressure and rate readings, gas lift measurements, and temperature.

A sixth feature, combinable with any of the following features, where the method further includes implementing three-year business operating plans for the reservoir and group of wells into an objective function with the at least one operating constraint.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at the application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented system, comprising:
measurement tools configured to provide real-time measurements for wells and reservoir performance for a reservoir and a group of wells;
control valves configured to be automatically controlled in response to events occurring in the group of wells;
a network configured to provide communications between the measurement tools, the control valves, and command centers, wherein the command centers are configured to provide information to reservoir and production engineers monitoring the group of wells;
a technical reservoir and production engineering domain configured to monitor, using the network, performance indicators for the reservoir and group of wells for events requiring corrective action to be taken in the reservoir and group of wells;
one or more processors; and
a non-transitory computer-readable storage medium coupled to the one or more processors and storing programming instructions for execution by the one or more processors, the programming instructions instructing the one or more processors to perform operations comprising:
determining that at least one operating constraint for the reservoir and group of wells exceeds pre-determined reservoir engineering limits by a pre-determined threshold of a global level field production target global level field production target;
automatically transmitting, through the network, instructions for performing a corrective action identified by a global level command center or a local level command center of a plurality of level command centers, the corrective action comprising choking, closing, relaxing, or opening of at least one well of the group of wells; and
automatically changing, based at least on the instructions, settings in one or more of the control valves for performing the corrective action.

2. The computer-implemented system of claim 1, wherein the measurement tools include permanent downhole pressure gauges, multi-phase flow meters, subsurface and surface pressure gauges, annulus pressure gauges, and temperature measurement devices.

3. The computer-implemented system of claim 1, wherein the measurement tools are monitored by reservoir and production engineers in global level and local level command centers.

4. The computer-implemented system of claim 1, wherein the network supports wired and wireless communications.

5. The computer-implemented system of claim 1, wherein the performance indicators are associated with subsurface and surface pressure readings, fluid flow rate measurements, water cut (WC), and gas oil ratio (GOR).

6. The computer-implemented system of claim 1, wherein the performance indicators include data types for reservoir pressure, oil production rates, gas production rates, water production rates, annulus pressure, electrical submersible pump (ESP) pressure and rate readings, gas lift measurements, and temperature.

7. The computer-implemented system of claim 1, the operations further comprising implementing three-year business operating plans for the reservoir and group of wells into an objective function with the at least one operating constraint.

8. The computer-implemented system of claim 1, wherein the at least one operating constraint is included in a production optimization problem transformed into command lines to be executed by command centers.

9. A computer-implemented method, comprising:
receiving, from measurement tools, real-time measurements for wells and reservoir performance for a reservoir and a group of wells;
monitoring, through a network, performance indicators for the reservoir and group of wells for events requiring corrective action to be taken in the reservoir and group of wells, wherein the network is configured to provide communications between the measurement tools, control valves of the group of wells, and command centers, and wherein the command centers are configured to provide information to reservoir and production engineers monitoring the group of wells;
determining that at least one operating constraint for the reservoir and group of wells exceeds pre-determined reservoir engineering limits by a pre-determined threshold of a global level field production target global level field production target;
automatically transmitting, through the network, instructions for performing a corrective action identified by a global level command center or a local level command center of a plurality of level command centers, the corrective action comprising choking, closing, relaxing, or opening of at least one well of the group of wells; and
automatically changing, based at least on the instructions, settings in one or more of the control valves for performing the corrective action.

10. The computer-implemented method of claim 9, wherein the measurement tools include permanent downhole pressure gauges, multi-phase flow meters, subsurface and surface pressure gauges, annulus pressure gauges, and temperature measurement devices.

11. The computer-implemented method of claim 9, wherein the measurement tools are monitored by reservoir and production engineers in global level and local level command centers.

12. The computer-implemented method of claim 9, wherein the network supports wired and wireless communications.

13. The computer-implemented method of claim 9, wherein the performance indicators are associated with subsurface and surface pressure readings, fluid flow rate measurements, water cut (WC), and gas oil ratio (GOR).

14. The computer-implemented method of claim 9, wherein the performance indicators include data types for reservoir pressure, oil production rates, gas production rates, water production rates, annulus pressure, electrical submersible pump (ESP) pressure and rate readings, gas lift measurements, and temperature.

15. The computer-implemented method of claim 9, the method further comprising implementing three-year business operating plans for the reservoir and group of wells into an objective function with the at least one operating constraint.

* * * * *